United States Patent [19]

Kawase et al.

[11] Patent Number: 4,996,852

[45] Date of Patent: Mar. 5, 1991

[54] CIRCULAR KNITTING MACHINE

[75] Inventors: Shinji Kawase; Toshiyuki Tanaka, both of Hyogo, Japan

[73] Assignee: Precision Fukuhara Works, Ltd., Japan

[21] Appl. No.: 511,187

[22] Filed: Apr. 19, 1990

[30] Foreign Application Priority Data

May 15, 1989 [JP] Japan ..... 1-55982[U]

[51] Int. Cl.[5] ..... D04B 9/06; D04B 15/32

[52] U.S. Cl. ..... 66/19; 66/8

[58] Field of Search ..... 66/8, 19

[56] References Cited

U.S. PATENT DOCUMENTS 1,147,649 7/1915 Scott ..... 66/19
1,387,783 8/1921 Kunau ..... 66/19
1,398,865 11/1921 larkin ..... 66/8

FOREIGN PATENT DOCUMENTS 1578661 11/1980 United Kingdom ..... 66/8

*Primary Examiner*—W. Carter Reynolds
*Attorney, Agent, or Firm*—Bell, Seltzer, Park & Gibson

[57] ABSTRACT

Conversion of a circular knitting machine having a particular diameter of needle cylinder to a machine having a different diameter of needle cylinder is permitted within a limited range of sizes of needle cylinders. This conversion is made possible by providing a plurality of sets of segmental knitting cam support blocks which may be positioned around needle cylinders of different diameters to reduce the normal number of parts which must be replaced when changing a particular knitting machine from one size needle cylinder to another. The number of yarn feeders associated with each segmental knitting cam support blocks of each set is determined so that the number of yarn feeders supported by each segmental knitting cam support block is equivalent to an integral multiple of one pitch covered by one yarn feeder.

4 Claims, 3 Drawing Sheets

CIRCULAR KNITTING MACHINE

FIELD OF THE INVENTION

This invention relates generally to a circular knitting machine which may be easily converted for permitting a limited range of needle cylinders and dials of different diameters to be used on the knitting machine, and more particularly to such a machine in which the number of parts to be replaced during conversion between a limited range of needle cylinder and dials of different diameters is substantially reduced.

BACKGROUND OF THE INVENTION

Conventional large diameter circular knitting machines are normally provided with a set of segmental cylinder knitting cam support blocks surrounding the needle cylinder of a given diameter, and a set of segmental dial knitting cam support blocks positioned on the dial for actuating the respective cylinder and dial needles at each yarn feeder. A plurality of yarn feeders and knitting cam segments are provided on each of the segmental knitting cam support blocks and spaced from each other so as to comprise an annular body. The number of yarn feeders in a circular knitting machine increases or decreases according to the diameter of the needle cylinder and the dial and the number of setting positions of the feeders also increases and decreases. The number of yarn feeders to be used with a needle cylinder of a given diameter is normally determined by equally dividing the circumference of the annular body by the space required for one yarn feeder to determine the width to be occupied by each arcuate part of each segment of the annular body and then making adjustments in widths of the segments to provide for increases or decreases in the number of yarn feeders. Thus, the number of segmental knitting cam support blocks required is determined by the given diameter of the needle cylinder to be employed. For example, in a circular knitting machine with a needle cylinder of 20 inches in diameter and with 41 yarn feeders, the annular body is first equally divided into 41 spaces. Then, if four feeders are to be carried by one segmental knitting cam support block, the annular body is divided into 10 segments, and the remaining one feeder $[41-(4\times10)=1]$is provided on one of the segmental knitting cam support blocks. When the circular knitting machine has a needle cylinder of 19 inches in diameter and with 39 yarn feeders, the annular body is first divided into nine segments and the remaining three feeders $[39-(4\times9)=3]$are supported on certain of the segmental knitting cam support blocks. Accordingly, the yarn feeders are equally supported on respective segmental knitting cam support blocks while any remaining yarn feeders are supported on other segmental knitting cam support blocks which are different in widthwise dimensions from the equally divided segmental knitting cam support blocks.

In accordance with this conventional arrangement, circular knitting machines of the same kind, but having needle cylinders of different size, are manufactured and a manufacturer of tubular knitted fabric must have circular knitting machines in the mill which are of various nominal sizes (diameters) in order to produce tubular fabric of different given diameters. If it were possible to easily convert a given size of knitting machine to permit a limited range of needle cylinders of different diameters to be used on a given circular knitting machine, the number of knitting machines required by the knitting fabric manufacturer could be reduced and many advantages could be offered to the management of knitting machines and to economy. For this purpose, the size or diameter of the knitting machine could be changed by reducing the number of replacement parts to be applied to the knitting machine by the common use of setting positions of segmental knitting cam support blocks to be replaced.

SUMMARY OF THE INVENTION

It is an object of the present invention to provide conversion means for a circular knitting machine in which a plurality of sets of the main parts of the knitting unit, particularly segmental knitting cam support blocks and segmental knitting cam segments supported thereby, are provided to easily permit a limited range of needle cylinders and dials of different diameters to be used on a particular knitting machine.

The illustrated knitting machine of the present invention is of the cylinder and dial type and is provided with knitting cam segments for actuating the knitting needles at each yarn feeder and these knitting cam segments are supported on sets of segmental knitting cam support blocks surrounding the needle cylinder and the dial. The widthwise dimensions between opposite sides of the segmental knitting cam support blocks of each set are varied so as to provide a certain number of segmental knitting cam support blocks dimensionally different from each other regardless of the particular size of the needle cylinder to be used in the knitting machine. The setting positions of the segmental knitting cam support blocks are common to various nominal sizes of needle cylinders and dials. Preferably, the number of yarn feeders supported on one segmental knitting cam support block is equivalent to an integral multiple of one pitch covered by one yarn feeder. The positions of the widthwise sides of adjoining segmental knitting cam support blocks are concentrated between setting positions of these segmental knitting cam support blocks when the nominal diameter of the needle cylinder and dial is varied.

The common setting positions of the segmental knitting cam support blocks of each set permit the easy conversion of a machine with a given nominal size or diameter of needle cylinder and dial to a knitting machine with a different nominal size or diameter of the needle cylinder and dial. Thus, a particular knitting machine can be easily changed from one diameter to another diameter, within a limited range of needle cylinders of different diameters. Accordingly, replacement of the component parts to which the sets of segmental knitting cam support blocks are fixed becomes unnecessary and the frequency required to replace parts can be reduced.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENT

Figure 1:
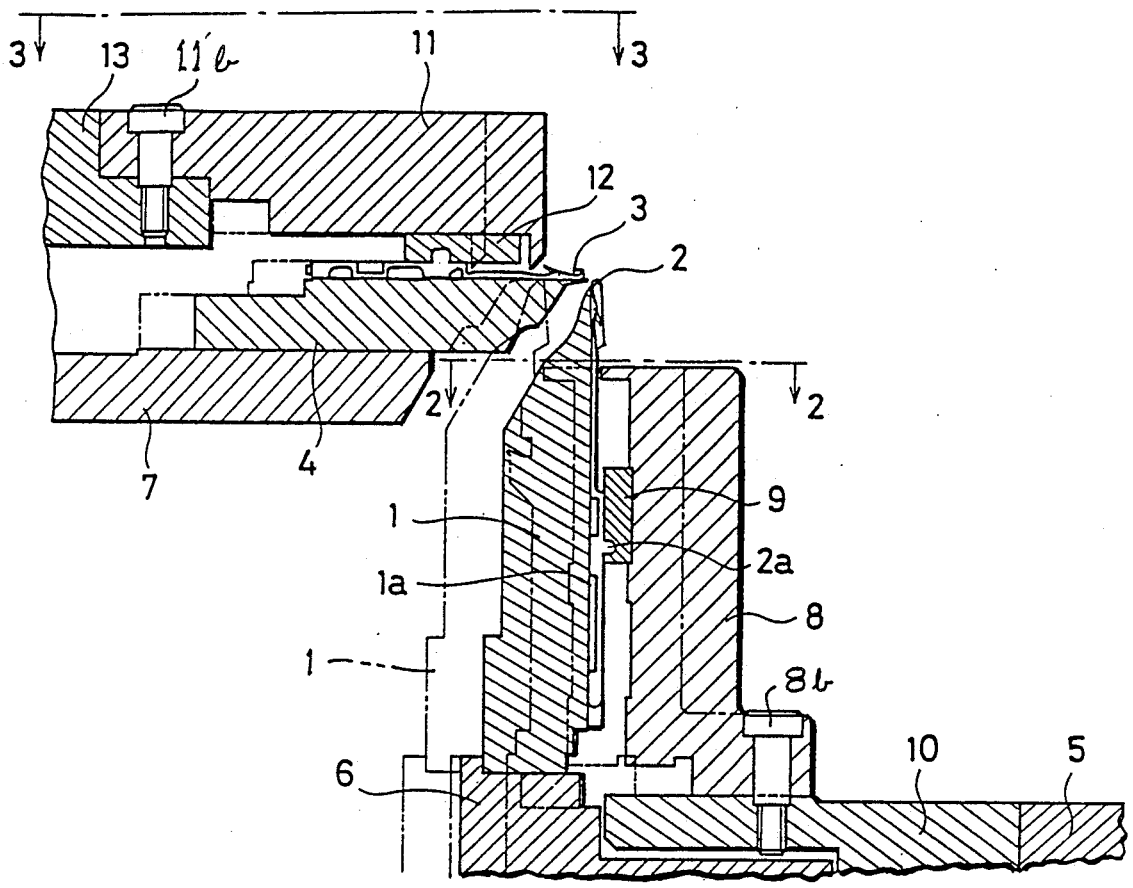
FIG. 1 is a vertical sectional view through the needle cylinder and dial of a circular knitting machine with a different size cylinder and dial shown in dash and two-dot lines.

As shown in FIG. 1, the conventional knitting machine includes a needle cylinder 1 with vertically extending needle grooves la formed on the outer periphery of the cylinder 1. A cylinder needle 2 is supported for vertical sliding movement in each of the needle grooves 1*a* and each cylinder needle 2 is provided with an operating butt 2*a*. Dial needles 3 operate in cooperation with the cylinder needles during knitting and are disposed horizontally and slide radially in grooves on a dial 4.

The needle cylinder 1 is rotatably supported in a circular bed plate 5 having given inner and outer diameters. The lower end of the needle cylinder 1 is fixed to a driving gear 6 while the dial 4 is fixed on a needle dial hub 7 which rotates at the same speed as the gear 6 by the usual driving mechanism so that the cylinder 1 and the dial 4 rotate at the same speed. Knitting cam segments 9 surround the needle cylinder 1 and are operable on the butts 2*a* to vertically move the cylinder needles 2 to form stitch loops of yarns fed to the needles in the usual manner.

The knitting cam segments 9 are supported on a set of segmental knitting cam support blocks 8. The segmental knitting cam support blocks 8 include inner peripheral surfaces supporting the knitting cam segments 9 thereon and in close proximity to the outer peripheral surface of the needle cylinder 1. The segmental knitting cam support blocks 8 are fixed on a circular cam retaining ring 10, as by bolts 8*b*. The circular cam retaining ring 10 includes an outer diameter adapted to closely fit within the inner diameter of the bed plate 5, and an inner peripheral circular edge of a given diameter surrounding the needle cylinder 1.

Dial knitting cam segments 12 are provided for actuating and controlling the radial movement of the dial needles 3 and are fixed to the lower surface of a set of segmental dial knitting cam support blocks 11 spaced above the dial needle hub 7. The segmental knitting cam support blocks 11 are fixed to a dial cap hub 13, as by bolts 11*b*. The dash and two-dot line in FIG. 1 indicates respective positions of the needle cylinder 1, the segmental knitting cam support block 8, the driving gear 6, the dial 4, and segmental dial knitting cam support block 11, when the nominal size of the machine is changed. A change of the nominal size or diameter of the knitting machine requires a change of size of the component parts.

Figure 2:
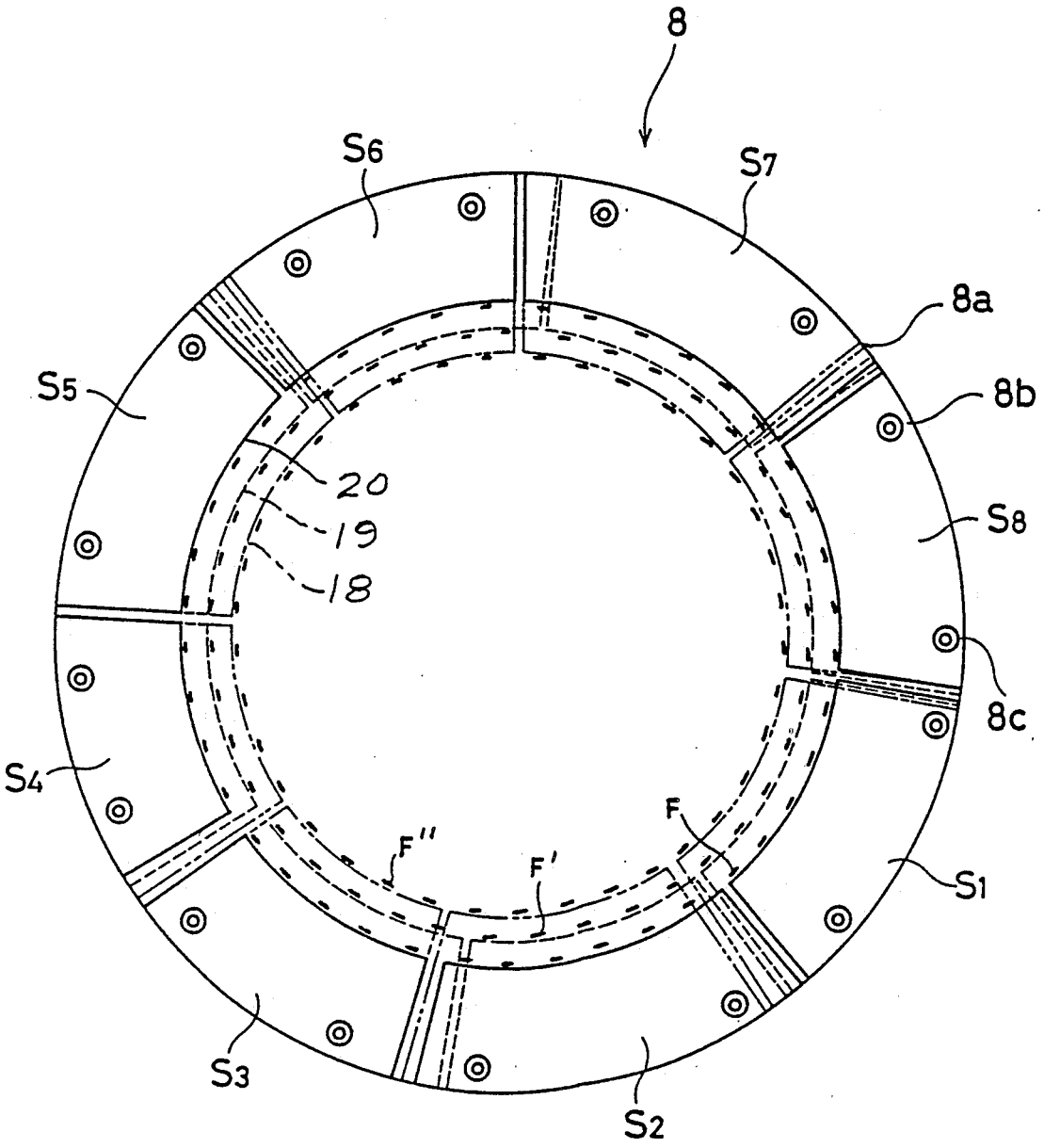
FIG. 2 is a somewhat schematic plan view taken along the line 2—2 in FIG. 1 and illustrating the sets of segmental cylinder knitting cam support blocks surrounding the needle cylinder, the set of support blocks shown in continuous lines indicating the setting position corresponding to a nominal size needle cylinder of 20 inches, the set of support blocks shown in dotted lines corresponding to a nominal size needle cylinder of 19 inches, and the set of support blocks shown in dash and two-dot lines corresponding to a nominal size needle cylinder of 18 inches.

As illustrated in FIG. 2, the conversion means of the present invention includes a plurality of sets of segmental cylinder knitting cam support blocks, broadly indicated at 8, and including individual segments $S_1$–$S_8$ having outer curved peripheral edges 8*a* collectively defining a circle of a given diameter. Each segment has two bolts 8*b*, 8*c* which support the segmental cylinder knitting cam support blocks 8 for different nominal sizes. Each of the segmental cylinder knitting cam support blocks 8 of each set includes widthwise dimensions so that the individual segmental knitting cam support blocks form a complete circle around the needle cylinder when positioned adjacent to each other. Each of the segmental cylinder knitting cam support blocks 8 of each set includes curved inner peripheral edges collectively defining respective circles of different diameters to be used when needle cylinders of corresponding different diameters are to be used in the knitting machine.

For example, the set of segments shown in solid lines in FIG. 2 include curved inner peripheral edges collectively defining a circle 20 to be used when a needle cylinder of a 20-inch diameter is to be used in the knitting machine. The curved inner peripheral edges of the set of segments shown in dotted lines in FIG. 2 define a circle indicated at 19 to be used when a needle cylinder of 19 inches is to be used in the knitting machine. The inner peripheral edges of the set of segments, shown in dash and two-dot lines in FIG. 2 and indicated at 18, are used when a needle cylinder of 18-inch diameter is to be used in the knitting machine.

The circumferential space to be covered by one segment 8 of each set is determined on the basis that one space or pitch is equivalent to an integral multiple of one pitch covered by one yarn feeder. For example, as shown by the continuous line in FIG. 2, with a circular knitting machine with a 20-inch diameter needle cylinder there are 41 yarn feeders F provided. Five yarn feeders are provided on the first segment $S_1$; six yarn feeders for the second segment $S_2$; five feeders for the third segment $S_3$; four feeders for the fourth segment $S_4$; five feeders for the fifth segment $S_5$; five feeders for the sixth segment $S_6$; six feeders for the seventh segment $S_7$; and five feeders for the eighth segment $S_8$. As shown by the dotted lines in FIG. 2, when constructing a circular knitting machine with a 19-inch needle cylinder size, one inch smaller than the 20-inch needle cylinder, with 39 feeders F′, four yarn feeders are provided for the fourth segment $S_4$ whereas five feeders are provided for each of the other segments. As shown by the dash and two-dot lines in FIG. 2, when constructing a circular knitting machine with an 18-inch needle cylinder, one inch smaller than the previous machine, with 37 yarn feeders F″, four yarn feeders are provided on the third, fourth and sixth segments $S_3$, $S_4$, and $S_6$, and five feeders are provided on the other remaining segments.

Figure 3:
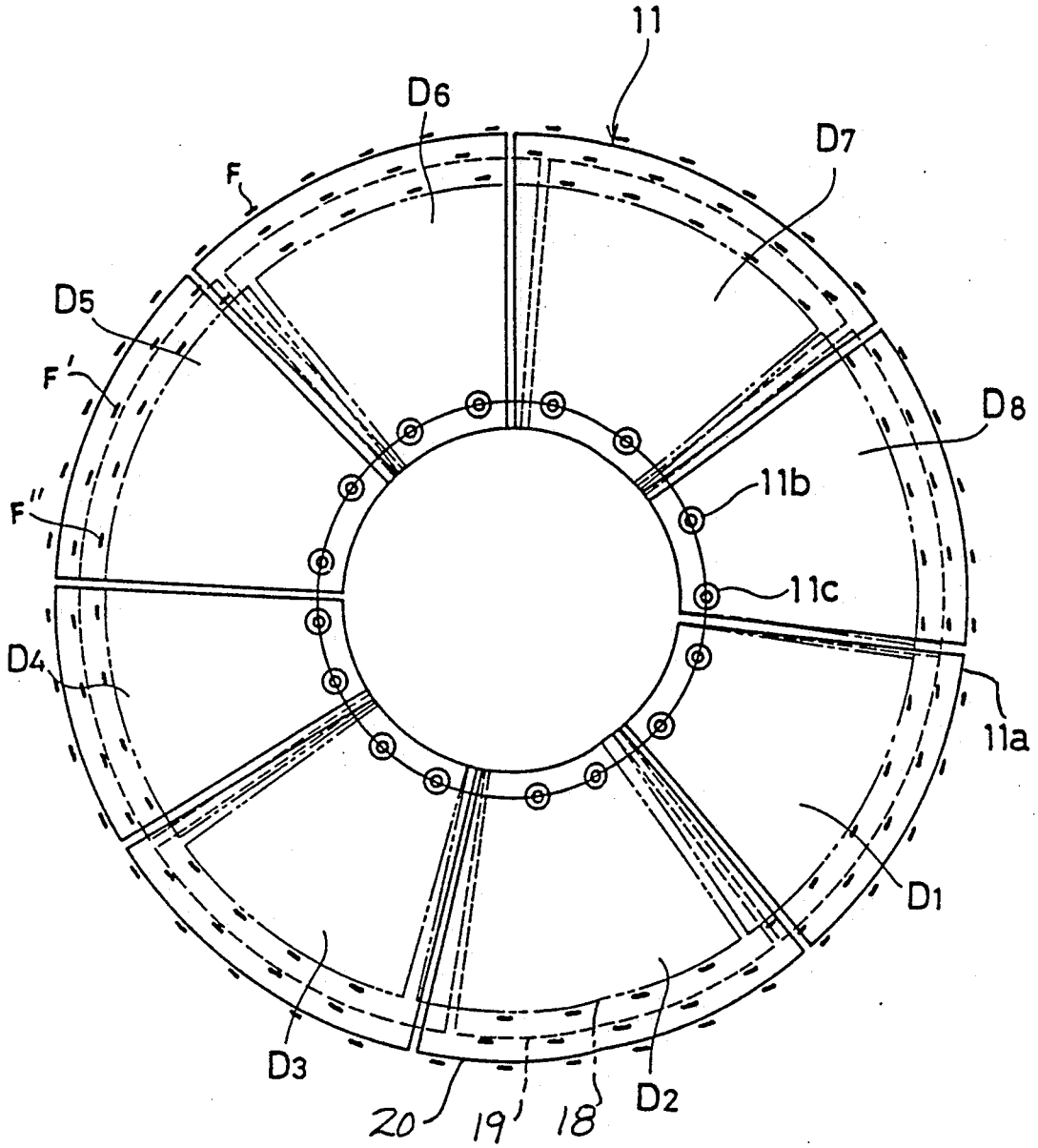
FIG. 3 is a somewhat schematic plan view taken along the line 3—3 in FIG. 1 and showing the sets of segmental dial knitting cam support blocks for actuating the dial needles, the set of support blocks shown in continuous lines illustrating the setting position corresponding to the nominal size dial of 20 inches, the set of support blocks shown in dotted lines corresponding to a nominal size dial of 19 inches, and the set of support blocks shown in dash and two-dot lines corresponding to the nominal size dial of 18 inches.

The arrangement of the sets of segmental dial knitting cam support blocks 11 is illustrated in FIG. 3, as illustrated by segments $D_1$–$D_8$. Each set of the segmental dial knitting cam support blocks includes outer curved peripheral edges collectively defining an outer circle 11*a* of a given diameter. Also, each segment of each set of the segmental dial knitting cam support blocks includes widthwise dimensions so that the individual segmental dial knitting cam support blocks collectively form a complete circle around the dial when positioned adjacent to each other. Each segment has two bolts 11*b*, 11*c* which are commonly usable for different nominal sizes.

In the same manner as the segmental cylinder knitting cam support blocks 8, the segmental dial knitting cam support blocks 11 are provided in various sizes. When a 20-inch diameter cylinder is used, as shown in solid lines in FIG. 3, 41 feeders F are provided: five feeders on the first segment $D_1$; six feeders on the second segment $D_2$; five feeders on the third segment $D_3$; four feeders on the fourth segment $D_4$; five feeders on the fifth segment $D_5$; six feeders on the sixth segment $D_6$; six feeders on the seventh segment $D_7$; and five feeders on the eighth segment $D_8$. When the knitting machine is adapted to use a 19-inch diameter cylinder, one inch smaller than the 20-inch cylinder, with 39 feeders F′, as shown by the dotted lines in FIG. 3, four yarn feeders are provided on the fourth segment $D_4$ and five feeders are provided on each of the other segments. When the knitting machine is to be provided with an 18-inch diameter cylinder, one inch smaller than the previous machine, with 37 yarn feeders F″, four yarn feeders are provided on the third, fourth and sixth segments $D_3$, $D_4$, and $D_6$ while five feeders are provided on the other segments.

For machines of other needle cylinder sizes, within a limited range, the number and size of the segments is calculated in the same manner as set forth above and the setting positions are made commonly adaptable to all segments by unequal division of the annular body into eight sections. In this way, a certain number of unequal sized segments can be fixed to the cam retaining ring 10 or the dial cap hub 13. In addition to the specific examples set forth above, the concept of this invention is applicable to not only the cylinder and dial knitting cam support blocks but to the sinker cap for holding the sinker cams in a single knit circular machine, in electronic pattern knitting circular machines, and to the cam holder for holding the electromagnets as well as to other various annular bodies on the knitting machine. In accordance with the present invention, the setting positions of the segments of each set are made commonly adaptable to a variety of nominal sizes within a limited range of diameters by cutting a certain number of segments obtained by unequal division of the annular body, regardless of the nominal size to be used.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A circular knitting machine including a circular bed plate having given inner and outer diameters, a circular cam retaining ring including an outer diameter adapted to closely fit within the inner diameter of said bed plate, said circular cam retaining ring being supported by said bed plate and including an inner peripheral circular edge of a given diameter surrounding a needle cylinder of a designated diameter, needles supported for vertical movement in said needle cylinder, knitting cam segments surrounding said needle cylinder and being operable to move said needles to form stitch loops of yarns fed to the needles, segmental knitting cam support blocks mounted on said circular cam retaining ring and including inner peripheral surfaces supporting said knitting cam segments thereon and in close proximity to said needle cylinder, and yarn feeders associated with each of said segmental knitting cam support blocks, the combination therewith of conversion means for permitting a limited range of needle cylinders of different diameters to be used on said bed plate and said circular cam retaining ring of said knitting machine, said conversion means comprising (a) a plurality of sets of said segmental knitting cam support blocks, and wherein the number of said yarn feeders associated with each of said segmental knitting cam support blocks is equivalent to an integral multiple of one pitch covered by one yarn feeder, (b) each of said segmental knitting cam support blocks of each set including outer curved peripheral edges collectively defining a circle of a given diameter, (c) each of said segmental knitting cam support blocks of each set including widthwise dimensions so that the individual segmental knitting cam support blocks form a complete circle around said needle cylinder when positioned adjacent to each other, and (d) each of said segmental knitting cam support blocks of each set including curved inner peripheral edges collectively defining respective circles of different diameters to be used when needle cylinders of corresponding different diameters are to be used in said knitting machine.

2. A circular knitting machine according to claim 1 wherein the setting positions of each of said segmental knitting cam support blocks of each set are common to each other.

3. A circular knitting machine according to claim 1 including a plurality of sets of segmental dial knitting cam support blocks.

4. A circular knitting machine according to claim 1 wherein said plurality of sets of said segmental knitting cam support blocks each comprises eight segmental knitting cam support blocks.

* * * * *